US006010308A

United States Patent [19]

Youn

[11] Patent Number: 6,010,308

[45] Date of Patent: Jan. 4, 2000

[54] CEILING FAN BLADE

[76] Inventor: Fang-Chan Youn, No. 3-3, Alley 81, Lane 258, Shui Yuan Road, Feng Yuan City, Taichung Hsien, Taiwan

[21] Appl. No.: 09/305,230

[22] Filed: May 4, 1999

Related U.S. Application Data

[63] Continuation-in-part of application No. 08/982,001, Dec. 1, 1997, abandoned.

[51] Int. Cl.[7] ..... F04D 29/34

[52] U.S. Cl. ..... 416/237; 416/5; 416/204 R; 416/210 R; 416/248

[58] Field of Search ..... 416/5, 202, 210 R, 416/204 R, 235, 236 R, 237, 248

[56] References Cited

U.S. PATENT DOCUMENTS

| | | | |
|---|---|---|---|
| 1,689,083 | 10/1928 | Ringel | 416/5 |
| 1,820,448 | 8/1931 | Davy | 416/237 |
| 2,385,070 | 9/1945 | Gant | 416/237 |
| 5,669,760 | 9/1997 | Chen | 416/210 R |

FOREIGN PATENT DOCUMENTS

| | | | |
|---|---|---|---|
| 525859 | 5/1955 | Italy | 416/5 |

OTHER PUBLICATIONS

Chemineer brochure "HE–3 High–Efficiency Impeller", dated Jan. 28, 1990.

*Primary Examiner*—Christopher Verdier
*Attorney, Agent, or Firm*—Charles E. Baxley, Esq.

[57] ABSTRACT

A ceiling fan blade for securing to a ceiling fan motor includes a flat root portion and a fan member each having a flange extended from one end and perpendicular to and solidly secured to the root portion and the fan member. The root portion and the fan member are inclined relative to each other for allowing the fan member to be directed toward a relative wind to the ceiling fan blade. The flanges of the fan member and of the root portion of the ceiling fan blade each includes a triangular shape and each includes a longitudinal axis coincident with each other for greatly increasing the strength of the ceiling fan blade.

4 Claims, 2 Drawing Sheets

CEILING FAN BLADE

The present invention is a continuation-in-part of U.S. patent application Ser. No. 08/982,001, filed on Dec. 1, 1997, now abandoned.

BACKGROUND OF THE INVENTION

1. Field of the Invention

The present invention relates to a blade, and more particularly to a ceiling fan blade.

2. Description of the Prior Art

Typical ceiling fan blades comprise three or more brackets secured to a ceiling fan motor and three or more fan blades secured to the brackets such that the fan blades may be secured to the ceiling fan motor by the brackets and such that the fan blades may be driven by the ceiling fan motor. The brackets each normally include one end secured to the ceiling fan motor and the other end having an inclined or tilted or twisted support for securing the fan blades and for allowing the fan blades to be inclined or tilted relative to the moving path of the fan blades and for allowing the fan blades to effectively drive the wind. The fan blades for ceiling fans are normally flat, such that the inclination of the fan blades relative to the moving path of the fan blades is determined by the brackets. However, the brackets are normally made of metal materials and include a great weight.

The present invention has arisen to mitigate and/or obviate the afore-described disadvantages of the conventional ceiling fan blades.

SUMMARY OF THE INVENTION

The primary objective of the present invention is to provide a ceiling fan blade which includes an excellent strength and which includes a suitable inclination for allowing the ceiling fan blade to be easily secured to the ceiling fan motor with the required inclination.

In accordance with one aspect of the invention, there is provided a ceiling fan blade for securing to a ceiling fan motor, the ceiling fan blade comprising a flat root portion for securing to the ceiling fan motor, the root portion of the ceiling fan blade including a first end having a first flange extended therefrom. The ceiling fan blade includes a fan body extended from the root portion of the ceiling fan blade and secured to the first flange of the root portion and inclined relative to the root portion of the ceiling fan blade for allowing the fan body to be directed toward a relative wind to the ceiling fan blade, the fan body of the ceiling fan blade including a first end adjacent to the root portion and having a second flange extended therefrom and solidly secured to the root portion of the ceiling fan blade.

The first flange and the second flange are perpendicular to the fan body and the root portion of the ceiling fan blade. The first flange and the second flange of the fan body and the root portion of the ceiling fan blade each includes a triangular shape. The fan body and the root portion of the ceiling fan blade each includes a longitudinal axis, the axes of the fan body and the root portion of the ceiling fan blade are coincident with each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
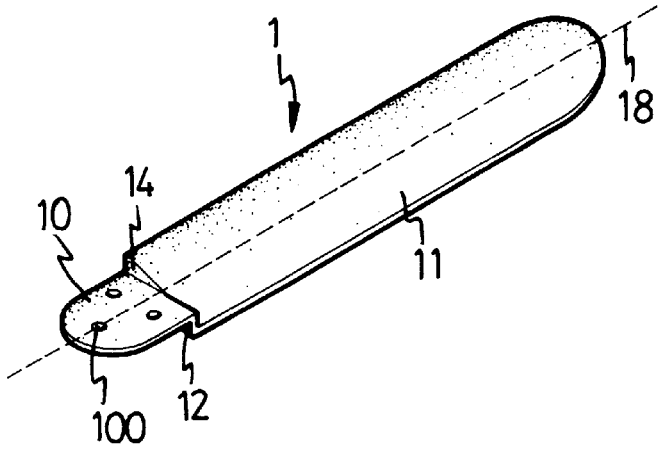
FIG. 1 is a perspective view of a ceiling fan blade in accordance with the present invention.
Figure 2:
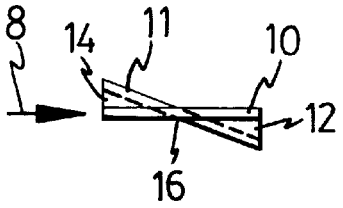
FIG. 2 is an end view of the ceiling fan blade.

Referring to the drawings, and initially to FIGS. 1 and 2, a ceiling fan blade in accordance with the present invention is generally indicated by the reference numeral 1 and comprises a flat root portion 10 for securing to the brackets 2 (FIG. 3) which are secured to the ceiling fan motor 4 for allowing the ceiling fan motor 4 to drive and to rotate the ceiling fan blades 1. Alternatively, the flat root portion 10 may also be directly attached and secured to the fan motor 4 so as to be driven by the fan motor 4. The root portion 10 of the ceiling fan blade 1 includes a number of holes 100 for engaging with fasteners which may solidly secure the ceiling fan blade to the bracket 2 or to the ceiling fan motor 4. The flat root portion 10 of the ceiling fan blade 1 includes a flange 12 having a substantially triangular shape and extended from one end thereof and adjacent to the fan body 11 of the ceiling fan blade 1.

Figure 3:
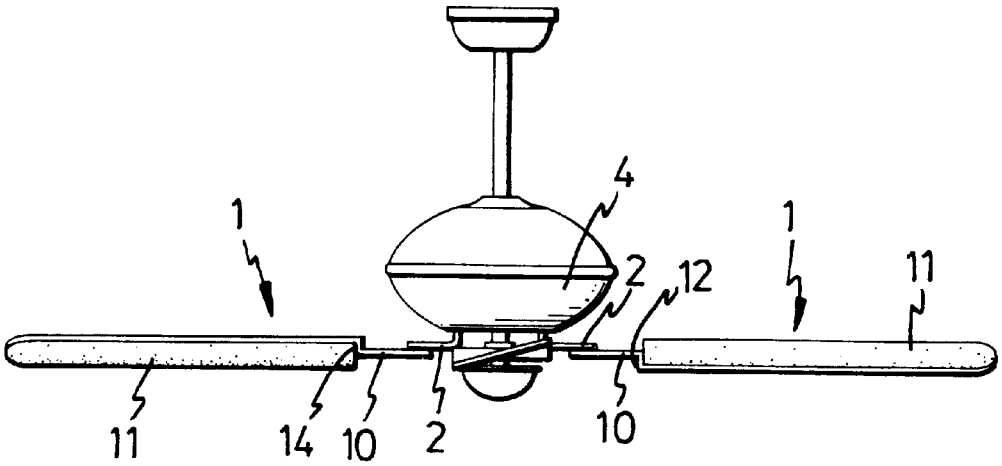
FIG. 3 is a plan view illustrating the application of the ceiling fan blade to the ceiling fan.

The fan body 11 of the ceiling fan blade 1 is inclined relative to the root portion 10 of the ceiling fan blade 1 and/or extended from the root portion 10 and inclined relative to the root portion 10 of the ceiling fan blade 1. As best shown in FIG. 2, the fan body 11 is inclined or tilted relative to the root portion 10 of the ceiling fan blade 1 for allowing the fan body 11 to face toward the relative wind 8 and for allowing the ceiling fan blades 1 to be easily secured to the ceiling fan motor 4 by the brackets 2. As shown in FIGS. 2, 3, the fan body 11 includes an inner end located adjacent to the root portion 10 and includes a flange 14 extended downward therefrom and solidly secured to root portion 10 or the ceiling fan blade 1 and also having a substantially triangular shape. The flange 12 of the root portion 10 of the ceiling fan blade 1 is also relatively and solidly secured to the fan body 11.

As best shown in FIG. 2, the adjacent ends of the root portion 10 and the fan body 11 of the ceiling fan blade 1 include a middle portion 16 secured together such that the longitudinal axes 18 of the root portion 10 and of the fan body 11 of the ceiling fan blade 1 coincide with each other (FIG. 1).

It is to be noted that the fan body 11 and the root portions 10 of the ceiling fan blades 1 are flat and the flanges 12, 14 of the root portion 10 and the fan body 11 of the ceiling fan blade 1 are perpendicular to the root portion 10 and the fan body 11 of the ceiling fan blade 1, such that the ceiling fan blade 1 may include an excellent and great shear strength. The ceiling fan blades 1 are preferably made of plastic material by molding or protruding or extruding processes such that the inclination of the ceiling fan blades may be solidly and accurately determined and formed. The perpendicular configuration of the flanges 12, 14 to the root portion 10 and the fan body 11 of the ceiling fan blade 1 allows the ceiling fan blade 1 to be easily and quickly manufactured by molding or extruding processes.

Accordingly, the ceiling fan blade in accordance with the present invention includes a suitable inclination for allowing the ceiling fan blade to be easily secured to the ceiling fan motor with the required inclination.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan blade for securing to a ceiling fan motor, said ceiling fan blade comprising:

a flat root portion for securing to the ceiling fan motor, said root portion of said ceiling fan blade including a first end having a first flange extended therefrom, said ceiling fan blade including a fan body extended from said root portion of said ceiling fan blade and secured to said first flange of said root portion and inclined relative to said root portion of said ceiling fan blade for allowing said fan body to be directed toward a relative wind to said ceiling fan blade, said fan body of said ceiling fan blade including a first end adjacent to said root portion and having a second flange extended from said first end of said fan body and solidly secured to said root portion of said ceiling fan blade.

2. The ceiling fan blade according to claim 1, wherein said first flange and said second flange are perpendicular to said fan body and said root portion of said ceiling fan blade.

3. The ceiling fan blade according to claim 2, wherein said first flange and said second flange each includes a triangular shape.

4. The ceiling fan blade according to claim 1, wherein said fan body and said root portion of said ceiling fan blade include a longitudinal axis coincident with each other.

* * * * *